US005445652A

United States Patent [19]

Connell et al.

[11] Patent Number: 5,445,652

[45] Date of Patent: Aug. 29, 1995

[54] METHOD FOR THE TREATMENT OF CELLULOSIC FIBRES WITH AMINO FUNCTIONAL AND SILICONE POLYMERS

[75] Inventors: David L. Connell, Derby; Kenneth M. Huddlestone, Nottingham; Anthony Szpala, Derby, all of England

[73] Assignee: Precision Processes Textiles, Derby, United Kingdom

[21] Appl. No.: 45,314

[22] Filed: Apr. 12, 1993

Related U.S. Application Data

[63] Continuation of Ser. No. 803,898, Dec. 9, 1991, abandoned, which is a continuation of Ser. No. 442,260, Nov. 28, 1989, abandoned.

[30] Foreign Application Priority Data

Dec. 6, 1988 [GB] United Kingdom ..... 8828414

[51] Int. Cl.[6] ..... D06M 13/325

[52] U.S. Cl. ..... 8/196; 8/181; 8/192; 8/194

[58] Field of Search ..... 8/115.66, 184, 181, 8/194, 196, 581, 555, 556, 557, 558; 252/8.8

[56] References Cited

U.S. PATENT DOCUMENTS

| | | | |
|---|---|---|---|
| 3,372,978 | 3/1968 | Whitefield et al. | 8/127.6 |
| 3,383,162 | 5/1968 | Whitfield et al. | 8/128.1 |
| 3,385,653 | 5/1968 | Whitfield et al. | 8/115.7 |
| 3,406,005 | 10/1968 | Whitfield et al. | 8/128.1 |
| 3,433,575 | 3/1969 | Whitfield et al. | 8/128.1 |
| 3,440,002 | 4/1969 | Whitfield et al. | 8/115.57 |
| 4,075,177 | 2/1978 | Bonnet et al. | 8/127.6 |
| 4,137,179 | 1/1979 | Koerner et al. | 8/115.6 |
| 4,152,273 | 5/1979 | Weiland | 8/115.6 |
| 4,419,391 | 12/1983 | Tanaka et al. | 252/8.8 |
| 4,446,033 | 5/1984 | Barrat et al. | 252/8.6 |
| 4,579,964 | 4/1986 | Totten et al. | 8/115.6 |
| 4,720,520 | 1/1988 | Huan et al. | 427/387 |
| 4,764,585 | 8/1988 | Heller et al. | 528/233 |
| 4,900,625 | 2/1990 | Kondo et al. | 428/383 |
| 4,913,705 | 4/1990 | Schlick et al. | 8/532 |
| 5,013,328 | 5/1991 | Annen et al. | 8/442 |
| 5,087,266 | 2/1992 | Connell et al. | 8/109 |

FOREIGN PATENT DOCUMENTS

| | | |
|---|---|---|
| 315477 | 5/1989 | European Pat. Off. . |
| 657753 | 9/1951 | United Kingdom . |
| 1113604 | 5/1968 | United Kingdom . |
| 1213745 | 11/1970 | United Kingdom . |
| 1406869 | 9/1975 | United Kingdom . |
| 2036052 | 6/1980 | United Kingdom . |
| 2082215 | 3/1982 | United Kingdom . |
| 2163760 | 3/1986 | United Kingdom . |

*Primary Examiner*—Paul Lieberman
*Assistant Examiner*—Caroline L. Dusheck
*Attorney, Agent, or Firm*—Wenderoth, Lind & Ponack

[57] ABSTRACT

A method for imparting a softer handle to cellulosic fibres which comprises treating the fibres with a) an amino functional polymer and b) silicone polymer capable of reacting with the reactive groupings of the amino functional polymer, so as to cause the polymers a) and b) to be applied to the cellulosic fibres. The method may be performed either as a continuous process or as a batch process.

10 Claims, No Drawings

METHOD FOR THE TREATMENT OF CELLULOSIC FIBRES WITH AMINO FUNCTIONAL AND SILICONE POLYMERS

This application is a continuation of now abandoned application, Ser. No. 07/803,898, filed Dec. 9, 1991, which is a continuation of now abandoned application, Ser. No. 07/442,260, filed Nov. 28, 1989.

This invention relates to a method for the treatment of cotton and other fibrous cellulosic materials so as to impart a softer handle.

Various ways of improving the feel or handle of cotton and other such materials are well known. For example, softening agents containing silicone polymers are widely used for application to cotton. Many such softeners are claimed to be durable to washing, but in reality this tends to mean merely that the softening agent is retained by the cotton fibres over a few wash cycles. This limited durability to washing compares favourably however, with the conventional non-silicone softeners which are readily removed by one domestic wash.

Japan Kokai 60-185863 describes the treatment of a cotton-polyester blend with liquors containing 0.1 to 1.0% polyethylene glycol fatty acid ester as a softening agent. This is claimed to give a moisture-permeable washfast fabric with a hygroscopic surface. EP-A-123935 relates to alkoxysilylalkyl functional group containing silicones which are curable with heating and are said to be useful as durable, laundering-stable lubricants and softening agents for textiles.

EP-A-32310 discloses organosilicone terpolymers containing a plurality of pendant polyoxyalkylene groups and a plurality of pendant hydrolysable silyl groups. These compounds are used as hydrophilic softening agents for natural and synthetic textile fibres. US-A-4152273 describes the manufacture of cotton and cotton-polyester textiles having improved soil-release properties. The method involves impregnating the textile with an aqueous composition containing a polyethylene polypropylene glycolisophorone diisocyanate condensate reacted with propylenimine, a silanol end-blocked methylpolysiloxane, dimethylaldihydroxyethyleneurea, a catalyst and softener, and then drying and heat curing.

Japan Kokai 49-80399 describes a fabric finishing technique involving the cross-linking of water-soluble basic polymers containing both amino and amide groups in the main chain with methoxymethyl melamines. A polyester fabric impregnated with such a composition, dried and then baked at 130° C. is said to exhibit washfast softener and antistatic properties. Japan Kokai 49-41697 relates to textile softening agents formed by treating a dicarboxylic acid with a polyethylenepolyamine, the amide amine being treated with a $C_{22}$–$C_{26}$ saturated fatty acid and then treated with an equivalent amount of a epihalohydrin in the presence of a lower alcohol. This gives a softening agent for textile fibres, such as nylon and polyester, which is said to be washfast over several washings.

DE-A-1928740 discloses a method for imparting fibres or fabrics, such as wool, silk, polyester and acrylic materials, with permanent elasticity, crease resistance and shrinkage resistance. This comprises treating the fibre or fabric with a non-aqueous solution containing less than 10% polyorganosiloxane prepolymer and a polymerisation catalyst, and then heat treating at a temperature of 50° to 200° C.

Even though certain of these treatments are described as washfast, as mentioned previously this often means in practice that they will survive only a limited number of washings. Those methods in which it is necessary to heat or bake the treated fabric at quite high temperatures in order to cure the polymers do tend to result in a soft handle having a better durability to washing, but the heating or baking itself can obviously be inconvenient and an additional expense. There is therefore a need for a method of imparting a softer handle to cotton and other cellulosic fibres which is both easy to perform and has improved durability to washing. The present invention provides such a method.

Cationic polymers are well known for use as retention and drainage aids in papermaking, where their principal action is flocculation of the fine cellulose fibres, reducing waste and making a paper with a greater wet strength. British Patent No. 1,213,745 describes various cationically active water soluble polyamides and processes for their production.

Many ways of rendering wool shrink resistant are known and which typically involve subjecting the wool to an oxidative treatment alone or, more commonly nowadays, followed by a polymer treatment. Various two-step shrink-proofing processes in which wool is treated first with an oxidative chlorinating agent and subsequently with a pre-formed synthetic polymer have been developed. A wide variety of polymers can be used in aqueous solution or dispersion, including polyamide-epichlorohydrin resins and polyacrylates. A review of work in this field by J. Lewis appears in Wool Science Review, May 1978, pages 23–42. British Patent Nos. 1,074,731 and 1,340,859 and U.S. Pat. Nos. 2,926,154 and 2,961,347 describe two-step shrink-proofing processes and resins or polymers suitable for use therein. These polymers are typically reactive polyamides. The polyamides can be derived from a polyalkylene polyamine and a dicarboxylic acid, e.g. diethylenetriamine and adipic acid, and are prepared by reaction with epichlorohydrin.

Our European Patent Application No. 0315477 describes a method for the treatment of wool so as to impart shrink resistance which comprises subjecting the wool to an oxidative pretreatment and then treating the wool with a) an amino functional polymer and b) a silicone polymer so as to cause the polymers to be applied to the wool fibres.

It will be appreciated, however, that the chemistry of wool is quite different from cellulosic fibres such as cotton. In the case of wool, where the fibre surface must first be treated with an oxidising agent in order for the polymer to adhere, the oxidised fibre surface bears strongly anionic groups which it is believed react with the cationic polymer to chemically bind it to the fibre surface. This is a well known principle, widely used for imparting shrink resistance to wool. Cotton, however, does not need shrink resist treatment in the same manner as wool. Accordingly, cationic polymers applied to wool in shrink resist treatments would not normally be applied to cotton and other such fibres.

According to the present invention there is provided a method for imparting a softer handle to cellulosic fibres which comprises treating the fibres with a) an amino functional polymer and b) a silicone polymer capable of reacting with the reactive groupings of the amino functional polymer, so as to cause the polymers a) and b) to be applied to the cellulosic fibres.

The amino functional polymer and the silicone polymer may be applied to the cellulosic fibres together (co-application) or the silicone polymer may be applied after the amino functional polymer (post-application). If desired, the polymers may be applied to the fibres in a combination of co-application and post-application techniques.

It has been found that the method of this invention can be used to produce cotton, and other fibrous cellulosic materials, having a softer handle which is significantly superior in durability to that achieved by other products currently on the market. In fact, using the particularly preferred treatment conditions, the improved handle can be regarded as substantially permanent over the lifetime of the garment. The main advantage of the present invention is thus the high quality of handle produced and its exceptional durability on prolonged washing over a large number of domestic wash cycles.

For the sake of brevity, the following account refers in general only to cotton and cotton fibres. It is to be understood, however, that the method of this invention can be used with any other fibrous cellulosic materials such as linen, artificial silk, cotton-polyester mixes and other cotton-rich textiles.

The polymer treatment which characterises the method of this invention comprises two components. The first is an amino functional polymer which contains reactive groupings such that it can be applied to the cotton and will form a film on the surface of the cotton fibres.

The second polymer component is a silicone polymer which is capable of reacting with the reactive groupings of the amino functional polymer component. The silicone polymer should be capable of exhausting onto the cotton fibres under the conditions of application herein described, or be capable of being made to exhaust onto the fibres upon the addition of various conventional exhaustion aids.

Suitable amino functional polymers for use in the method of this invention include the reactive cationic polymers formed, for example, by reaction of:

i) precursor amine-containing polymers such as: amino amides produced by reacting di- or polyfunctional acids with polyamines containing three or more amino groups; condensation polymers produced by reacting dicyandiamide and polyamines containing three or more amino groups; polyethylene imine; addition polymers, such as may be prepared from ethylene oxide, acrylic acid and its derivatives or acrylonitrile, into which amino functional groups have been introduced by subsequent reaction or by copolymerisation of a suitable comonomer already bearing an amino functional group; with ii) di or polyfunctional reactive species such as: epichlorohydrin; di or polyepoxy compounds such as bisphenol A resin; polyhalogenated hydrocarbons; reactive short chain amine/epichlorohydrin prepolymers. Suitable polymers of the latter type are described in British Patent No. 1,213,7454, which discloses a process for the production of cationically active, water soluble polyamides which is characterized in that a polyalkylenepolyamine which contains two primary amino radicals, at least one secondary amino radical and at least two alkylene radicals with 2 to 4 carbon atoms, is reacted with a dicarboxylic acid of the formula $$HOOC—C_mH_{2m}—COOH \qquad \text{I}$$

in which m is a whole number of from 4 to 8, or a functional derivative of said dicarboxylic acid, the molecular proportion being 0.85:1 to 1.2:1, and the reaction product is reacted in aqueous solution with a bifunctional agent of the formula

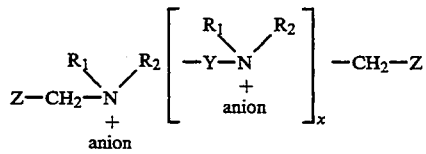

II wherein x is zero or a whole number up to 7,

Z is selected from

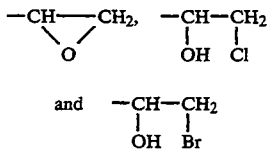

each of $R_1$ and $R_2$ is selected from lower alkyl and lower hydroxyalkyl radicals, Y is selected from alkylene radicals with from 2 to 6 carbon atoms, 2-hydroxy-1,3-propylene radicals, $$—CH_2—CH_2—NH—CO—NH—CH_2—CH_2— \text{ and}$$

$$—CH_2—CH_2—CH_2—NH—CO—NH—CH_2—CH_2—CH_2—,$$

until the bifunctional agent is used up, the amount of the bifunctional agent being chosen in such a way that the resulting reaction product remains in solution.

Other cationic polymers capable of exhaustion on cotton and bearing groupings capable of reacting with the silicone polymer could of course be used. This includes polymers manufactured by the reaction of amines or polyamines and epichlorohydrin, amines or polyamines and dicyandiamide. Such polymers are described in British Patent Nos. 657,753 and No. 2,163,760.

British Patent No. 657,753 discloses a process for the preparation of water-soluble organic nitrogen compounds characterized in that a polyalkylene or polyhydroxyalkylenepolyamine, the alkylene groups of which contain two or three carbon atoms, or derivatives of these amines reacting in the same manner as the amines themselves, are condensed in the absence of water and if desired in the presence of a non-aqueous solvent boiling above 125° C. at an elevated temperature with cyanamide, dicyandiamide, or guanidine, with splitting off at least ½ mol of ammonia per mol of cyanamide and at least one mol of ammonia per mol of dicyandiamide or guanidine. Suitable polyalkylenes are, for example, diethylenetriamine, triethylenetetramine or high molecular polyethylenepolyamines, polypropylenepolyamines, di-(hydroxypropylene)-triamines or higher molecular poly(hydroxypropylene)-polyamines, or derivatives reacting in the same way as these amines, for example, carbonates thereof.

British Patent No. 2,163,760 discloses a cationic polycondensate which is (A) the product of reacting (a) a monofunctional or polyfunctional amine having one or more primary and/or secondary and/or tertiary amino groups, in free base or salt form, with (b) cyanamide, dicyandiamide, guanidine or bisguanidine, in which up to 50 mole percent of the cyanamide, dicyandiamide, guanidine or bisguanidine may be replaced by a dicarboxylic acid or a mono- or di-ester thereof, in the presence of a catalyst (K) selected from metals, metal salts and heterocyclic nitrogen-containing organic bases, provided that when (K) is a salt of a metal of group II the amount of (K) is less than 0.5% by weight based on the total weight of components (a) and (b), said product (A) containing at least one free hydrogen atom linked to a nitrogen atom; in the absence of water, at temperatures above 50° C.; or (B) the product of reacting (A) with:

(c) an N-methylol derivative of a urea, melamine, guanamine, triazine, urone, urethane or acid amide, or (d) an epihalohydrin or a precursor thereof, or (e) formaldehyde or a compound which releases formaldehyde; or (C) the product of reacting (A) with [(d) and (c)] or with [(e) and (c)].

While these polymers will normally be applied to the cotton as aqueous solutions, it is to be understood that aqueous dispersions of polymers may also be used provided that they are capable of forming a suitable coating on the cotton fibres.

Suitable silicone polymers for use in the method of this invention are those bearing groups capable of reacting with the reactive groups present on the amino functional polymer component under the conditions of processing, and which are also capable of being exhausted onto the cotton fibres under these conditions or upon the addition of exhaustion aids. The silicone polymers will normally be aqueous dispersions or emulsions, occasionally microemulsions, stabilised by suitable surfactant systems which confer a certain ionicity to the droplets in some cases. Nonionic, cationic and anionic systems may be employed as long as the ionicity of the surfactant used to stabilise the emulsion does not interfere with the exhaustion of the silicone the onto the fibre and the subsequent reaction between the two polymer films.

Suitable silicone polymers include those bearing amino, thiol or epoxy functional groups. Examples of such polymers are as follows:

i) Amino functional silicone polymers

Ucarsil Magnasoft, Magnasoft Microemulsion TP 202 (Union Carbide). Ucarsil Magnasoft is a low viscosity material available as a fluid or a 40% nonionic emulsion, and Magnasoft Microemulsion TP 202 is a low viscosity clear liquid, also of nonionic type, having the following properties:

Silicone actives % : 35

Viscosity at 25° C. cst: 500 pH 25° C. : 6

Specific gravity at 25°/25° C.: 1.0

These materials have the formula

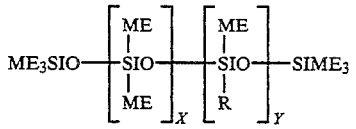

R = $CH_2CH_2CH_2NCH_2CH_2NH_2$
H

VP 1019, VP 1441E, VP 1460E, VP 1657E (Wacker Chemicals). For example, VP 1441E is a slightly cationic emulsion of a reactive linear dimethyl polysiloxane, supplied as an emulsion containing 50% of the active substance, and having a pH of 5–7, a specific gravity of about 1 and a shelf life of at least 9 months.

Crosil R (Crossfield Textile Chemicals).

Ultratex TC 661, Ultratex ESU (Ciba Geigy).

ii) Thio functional silicone polymers

Tegosevin 503/9 (Goldschmidt).

SLM 42 235/3, SLM 42 235/4 (Wacker Chemicals). Both of these materials are 35% nonionic emulsions of mercapto modified silicones containing approximately 0.3% by weight of -SH groups of the active ingredients, having a viscosity of approximately 200 cst. The former is non-reactive and the latter is reactive in respect of the end chain groups.

iii) Epoxy functional silicone polymers

Ucarsil TE-24, Ucarsil SFT (Union Carbide). For example, Ucarsil TE-24 is an epoxy functional silicone polymer, available as an emulsion, and having the formula

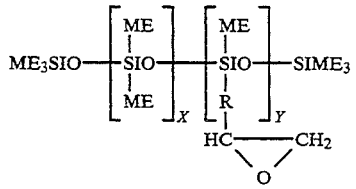

The use of the silicone polymer VP 1487E, a cationic emulsion of silicones, is particularly preferred.

The polymer treatment may be carried out at various stages in the processing of the cotton fibres, or could be performed on the made up finished garment.

The two polymers may either be applied together from one bath (co-application) or from two successive baths (post application). In the latter case, drying of the cotton should not be allowed to occur between the baths. If a post-application procedure is adopted, the silicone polymer is applied after the amino functional polymer. For application purposes, the two polymers may be incorporated, together or individually, into formulations containing other ingredients such as crease-resist resins. They may also contain other materials, for example, antistatic agents either as a formulated mixture or as a modification to the polymer system. The two polymers may also be formulated together for application purposes if practicable.

With regard to the proportions to be used of the two polymer components, the amino functional polymer will normally be present in the minor amount and the silicone polymer component present in the major amount. The amino functional polymer is applied to the cotton in an amount of from 0.01 to 0.5% on the weight of fibre (o.w.f.). The silicone polymer is usually applied to the cotton in an amount of from 0.1 to 3.0%, preferably 0.3 to 0.7%, on the weight of fibre. Unlike some silicone systems, there is no need to use silicone or silane based crosslinking agents to generate the wash fastness. In both cases the polymer exhausts from the bath at ambient temperature and commercial liquor ratios (30:1). Under very simple application conditions, the preferred material exhausts readily and completely onto the fibre, whereas other conventional silicone durable softeners have been found to exhaust incompletely even when applied at much greater concentrations than envisaged herein.

Following the polymer treatment, the cotton is dried and may then be further processed in the usual manner.

It has surprisingly been found that treatment of cotton with an amino functional polymer and a silicone polymer produces a soft handle which is also durable to washing. A still further advantage of the present method is that the use of the components as hereinbefore defined results in a high speed cure at relatively high moisture content. The system is self-curing and avoids the need to heat or bake fabrics at elevated temperatures.

The method of this invention may be operated as either a continuous process or a batch process and may be performed at any stage in the processing of cotton to produce a finished article.

The present invention will now be illustrated by the following Examples, which are included solely for the purposes of illustration and are in no way intended to be limiting. All parts and percentages are by weight.

EXAMPLE 1

Preparation and Selection of Polymers a) Polymer 1a—A partially crosslinked polyaminoamide polymer was prepared according to the following three-stage synthesis:

i) Reaction of a dicarboxylic acid with a polyalkylene polyamine 109 kg (1.06 kg mol) of diethylenetriamine are diluted with 40 kg of water in a vessel provided with a stirrer while applying external cooling in such a way that the internal temperature remains below 70° C. Thereafter 146 kg (1.00 kg mol) of powdered adipic acid are added sufficiently slowly for the inner temperature to be maintained at 50°-90° C. by external cooling. The vessel with stirrer is closed and provided with a fractionating column which is joined to a descending cooler. Thereafter, during 1 hour, heating to 120°-130° C. by means of an oil bath under an atmosphere of nitrogen is effected followed by heating during 6 hours to an internal temperature of 170°-175° C. The water used for dissolution and that which results during the condensation is thus distilled off through the column, but less than 0.4 kg of diethylenetriamine is entrained in this way by the water vapour. Stirring is continued for a further 3 hours at 170°-175° C. and the column with the descending cooler is then replaced with a reflux condenser. After cooling to 150°-160° C., 219 kg of water are added in such a way that the inside temperature gradually falls to 100°-105° C. under continuous reflux. Boiling is continued for one hour under reflux; after cooling, a clear solution of the intermediate product is obtained which contains 50% of solid substance.

ii) Production of the bifunctional agent 205.5 kg of ice are mixed with 112.5 kg of 40% dimethylamine solution (1 kg mol) in a vessel of stainless steel provided with a stirrer and 100 kg of a 36.5% hydrochloric acid solution (1 kg mol) are added in such a way that the inner temperature remains below 25° C. A solution of dimethylammonium chloride of pH value 4–7 results. A further 112.5 kg of a 40% dimethylamine solution (1 kg mol) are added and then 277.5 kg of epichlorohydrin are run in sufficiently slowly so that the internal temperature can be kept at 28°-32° C. by external cooling. The reaction is allowed to go to completion at this temperature for a few hours and a clear solution results which contains 50% of cross-linking agent of sufficient purity of the formula:

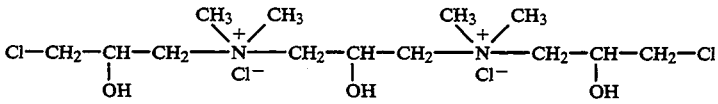

iii) Reaction of the products from steps i) and ii)

10 kg of the 50% product solution of step i) are mixed with 2.52 kg of the 50% bifunctional agent solution obtained in step ii) and with 8.38 kg of water in a heatable vessel provided with stirrer. While stirring well, heating is effected for 1 hour to 90° C. in an atmosphere of nitrogen and that temperature is maintained for 2 hours. After cooling, a 30%, clear, fairly viscous solution of a cross-linked, cationically active polyamide is obtained.

This product was then reacted with 0.5 equivalents of hydrochloric acid and 0.5 equivalents of epichlorohydrin in the following manner:

875 kg of the polymer (26% solids) are placed in a suitable reactor. 49.4 kg of hydrochloric acid (30% strength) are diluted in 38 kg of water. The diluted hydrochloric acid solution is then added to the polymer and thoroughly mixed with stirring. The temperature is maintained at about 25° C. (but not less than 20° C.). Stirring is continued throughout the reaction. 37.6 kg of epichlorohydrin are then added to the acidified polymer solution and the mixture stirred at ambient temperature for a further 24 hours. The resultant polyamide is stabilised with formic acid to a pH of 3.5 ±0.1 (as measured on a 5% solids solution). Resultant polymer solids was 25%.

b) Polymer 1b—A partially crosslinked polyaminoamide polymer was prepared according to steps i), ii) and iii) of the procedure for Polymer 1a.

This product is then reacted with 0.5 equivalents of epichlorohydrin in the following manner:

875 kg of the polymer (26% solids) are placed in a suitable reactor. 87.4 kg of water are added and thoroughly mixed with stirring. The temperature is maintained at about 25° C. Stirring is continued throughout the reaction. 37.6 kg of epichlorohydrin are then added to the polymer solution and the mixture stirred at ambient temperature for a further 24 hours. Care must be taken to ensure that the temperature does not exceed about 25° C. during this period. The resultant polyamide is stabilised with formic acid to a pH of 3.5 ±0.1 (as measured in a 5% solids solution). Resultant polymer solids was 25%.

c) Polymer 1c—A polyaminoamide polymer was prepared from diethylene triamine and adipic acid according to step i) of the procedure for Polymer 1a.

This product was then reacted with 1.0 equivalent of epichlorohydrin for 12 hours at ambient temperature, then for 1.5 hours at 75° C. Resultant polymer solids was 25%.

d) Polymer 1d—Hercosett 125.

Hercosett 125 is a commercially available polyaminoamide polymer (prepared from diethylene triamine and adipic acid) reacted with epichlorohydrin. Polymer solids content is 12.5%.

e) Polymer 1e—A copolymer was prepared from 3.0 moles of methyl methacrylate and 1.0 mole of 2-(dimethylamino) ethyl methacrylate and reacted with 1.0 mole of epichlorohydrin in the manner described in our European Patent Application No. 0129322. Final polymer solids content was 30%.

f) Polymer 1f—VP 1445E.

VP 1445E is a commercially available poly(dimethylsiloxane)α, W diol emulsion which contains reactive alkyl amino side groups. VP 1445E is sold by Wacker Chemicals. Polymer solids content is 35%.

g) Polymer 1g—A commercially available poly(-dimethylsiloxane)α, W diol in a cationic emulsion which contains alkyl amine side groups. This polymer is sold by Wacker Chemicals. Polymer solids content is 25%.

Applications to Knitted Cotton/Nylon Socks

In the following examples liquor volume to sock weight ratio was 30:1 throughout, unless otherwise stated. The abbreviation o.w.g. stands for on weight of goods.

Measurement of Durability

The durability conferred by the various treatments was assessed by washing according to the test method HLCC7 or HLCC4 of the Home Laundering Consultative Council and carrying out handle assessments after washing.

of 6 for 5 minutes to wet out and equilibrate. 4% Ceranine PNP o.w.g. prediluted with water (approximately 4 parts Ceranine PNP to 50 parts water) was added to the bath and stirring continued until the softener had exhausted onto socks (as indicated by a completely clear bath—the softener is turbid in water). The socks were hydroextracted and tumble dried then post boarded at 245° C. using the sequence: steam for 50 seconds, dry for 60 seconds.

b). Dyed cotton/nylon terry loop socks were stirred at a pH of 7.0 for 5 minutes to wet out and equilibrate. 0.3% Polymer of Example 1c prediluted with water (approximately 0.3 parts Polymer of Example 1c to 50 parts water) o.w.g. was drip fed over a period of 5 minutes and run for a further 5 minutes. Then 1.2% Polymer of Example 1 g o.w.g. prediluted with water (approximately 1 part Polymer of Example 1 g to 50 parts water) was drip fed over 5 minutes and stirring continued until the polymer had exhausted onto the socks (as indicated by a clear bath). The socks were hydroextracted, tumble dried and postboarded as in 2a).

c). Socks were wet at pH 7.0 then 0.2% Polymer of Example 1c and 1.2% Polymer of Example 1 g applied as in Example 2b).

d). Socks were wet out at pH 7.0 then 0.2% Polymer of Example 1c and 1.0% Polymer of Example 1 g applied as in Example 2b).

EXAMPLE 2e

Effectiveness of treatments applied in Example 2a–d was evaluated by subjecting to cumulative HLCC7 washes and carrying out handle assessments, i.e. various assessors were provided with coded socks and asked to rank them in order of preference for softness. (Softness in this instance will be related to durability in that a reduction of softness by repeated washing is indicative of the degree of durability of the finish).

The various rankings were then added together to provide an overall numerical ranking of the socks. The rankings before and after various stages of washing are shown overleaf (1=best, 5=worst).

| | HANDLE ASSESSMENT RESULTS | | | | | | | |
|---|---|---|---|---|---|---|---|---|
| | BEFORE WASH | | AFTER 1 HLCC7 | | AFTER 5 HLCC7 | | AFTER 10 HLCC7 | |
| Application | *Points | Ranking | Points | Ranking | Points | Ranking | Points | Ranking |
| 1. Example 2a) 4% Ceranine PNP | 13 | =3 | 8 | 4 | 6 | =4 | 6 | =4 |
| 2. Example 2b) 0.3% Polymer of Example 1c followed by 1.2% Polymer of Example 1g | 13 | =3 | 17 | =1 | 19 | 1 | 20 | 1 |
| 3. Example 2c) 0.2% Polymer of Example 1c followed by 1.2% Polymer of Example 1g | 16 | 1 | 17 | =1 | 17 | 2 | 16 | 2 |
| 4. Example 2d) 0.2% Polymer of Example 1c followed by 1.0% Polymer of Example 1g | 14 | 2 | 14 | 3 | 12 | 3 | 12 | 3 |
| 5. Untreated sock | 4 | 5 | 4 | 5 | 6 | =4 | 6 | =4 |

*Points are cumulative totals for 4 assessors
Maximum (best) possible = 20
Minimum (worst) possible = 4

EXAMPLE 2 a). A known commercial softening agent, Ceranine PNP (cationic softener, emulsion of fatty acid condensation products, Sandoz Limited) was applied as follows. Dyed cotton/nylon terry loop socks were stirred in a water bath containing $\frac{1}{4}$ ml $l^{-1}$ acetic acid at a pH

EXAMPLE 3 a). Dyed cotton/nylon terry loop socks were wet out in a water bath at pH 7.0 for 5 minutes. 1.2% Polymer of Example 1 g o.w.g. prediluted with water (approximately 1 part Polymer of Example 1 g to 50 parts water)

was added to the bath and stirring continued until the polymer had exhausted onto the socks (as indicated by a clear bath). It took approximately 6 minutes to exhaust about 90% of the system. Temperature was raised to 35° C. to complete exhaustion. The socks were hydroextracted, dried and postboarded as in Example 2a).

b). Socks were wet out at pH 7.0 as in Example 2a) then 0.3% Polymer of Example 1c o.w.g. prediluted with water, was drip fed over a period of 5 minutes. Then 1.2% Polymer of Example 1 g o.w.g., prediluted with water, was drip fed over 5 minutes. The system took approximately 8 minutes to exhaust onto the socks after drip feeding at ambient. The socks were hydroextracted, dried and postboarded as in Example 2a).

c). Socks were wet out at pH 7.0 as in Example 2a) then a combination of 0.3% Polymer of Example 1c and 1.2% Polymer of Example 1 g, prediluted with water, was added to the bath in one go. The system took approximately 8 minutes to exhaust at ambient. The socks were hydroextracted, dried and postboarded as in Example 2a).

d). Socks were treated as in Example 3c). However, in this instance, 0.2% Polymer of Example 1c and 1.2% Polymer of Example 1 g were coapplied. The system took 5 minutes to exhaust.

EXAMPLE 3e

Effectiveness of treatments applied in Example 3a–d was evaluated by subjecting to cumulative HLCC7 washes and carrying out handle assessments.

| | HANDLE ASSESSMENT RESULTS | | | |
|---|---|---|---|---|
| | BEFORE WASHING | | AFTER 10 HLCC7 WASHES | |
| Application | *Points | Ranking | *Points | Ranking |
| 1. Example 3a) 1.2% Polymer of Example 1g | 18 | 1 | 8 | =4 |
| 2. Example 3b) 0.3% Polymer of Example 1c followed by 1.2% Polymer of Example 1g | 10 | 4 | 16 | =1 |
| 3. Example 3c) 0.3% Polymer of Example 1c coapplied with 1.2% Polymer of Example 1g | 17 | 2 | 16 | =1 |
| 4. Example 3d) 0.2% Polymer of Example 1c coapplied with 1.2% Polymer of Example 1g | 11 | 3 | 16 | =1 |
| 5. Untreated Sock | 4 | 5 | 4 | =5 |

*Maximum (best) possible = 20
Minimum (worst) possible = 4

EXAMPLE 4 a). Dyed cotton/nylon terry loop socks were stirred in a water bath containing ¼ ml $l^{-1}$ acetic acid for 5 minutes at 40° C. 2% Ceranine PNP o.w.g. and 1% Dylachem Lubricant SPC o.w.g. (cationic wax emulsion specially formulated to improve the handle and postboarding performance of hosiery, Precision Processes (Textiles) Limited prediluted with water were added to the bath and stirring continued until the softener system had exhausted onto the socks (as indicated a clear bath). The socks were hydroextracted, dried and postboarded as in Example 2a).

b). Dyed cotton/nylon terry loop socks were stirred in a water bath at pH 5.5 and 30° C. 2% Ultratex ESB o.w.g. (cationic silicone softener emulsion, Ciba Geigy) prediluted with water was added to the bath and stirring continued until the polymer had exhausted onto the socks (as indicated by a clear bath). The socks were hydroextracted, dried and postboarded as in Example 2a).

c). Socks were wet out at pH 5.5 and 30° C., then 2% Ultratex EMJ o.w.g. (Microemulsion of an aminofunctional polydimethylsiloxane, Ciba Geigy) applied as in Example 4b).

d). Socks were wet out at pH 5.5 and 30° C., the n 2% Ultratex TC840 o.w.g. (cationic silicone softener emulsion, Ciba Geigy) applied as in Example 4b).

e). Socks were wet out at pH 5.5 and 30° C., then 1.5% Edonine SE conc. o.w.g. (60% solids cationic silicone softener emulision, I.C.I.) applied as in Example 4b).

f). Socks were wet out at pH 5.5 and 30° C., then 1.5% Polymer of Example 1 g o.w.g. applied as in Example 4b).

g). Socks were wet out at pH 5.5 and 30° C., then a combination of 0.3% Polymer of Example 1c o.w.g. and 1.2 % Polymer of Example 1 g o.w.g. applied as in Example 4b).

h). Socks were wet out at pH 6.5 and 30° C., then 0.5% Sandofix TPS o.w.g. (cationic dye finishing agent, amine polycondensation product, Sandoz Products Limited) prediluted with water added to the bath and run for a further 5 minutes. 1.2% Polymer of Example 1 g o.w.g. prediluted with water was added and stirring continued until the polymer had exhausted. The socks were hydroextracted, dried and postboarded as in Example 2a).

EXAMPLE 4i

Effectiveness of treatments applied in Example 4a–h was evaluated by subjecting to cumulative HLCC7 washes and carrying out handle assessments. Results are given below:

| | HANDLE ASSESSMENT RESULTS | | | |
|---|---|---|---|---|
| | BEFORE WASH | | AFTER 10 HLCC7 WASHES | |
| Application | *Points | Ranking | *Points | Ranking |
| 1. Example 4a) 2% Ceranine PNP coapplied with 1% Lubricant SPC | 17 | =5 | 13 | =7 |
| 2. Example 4b) 2% Ultratex ESB | 11 | 8 | 13 | =7 |
| 3. Example 4c) 2% Ultratex EMJ | 34 | =1 | 21 | 4 |
| 4. Example 4d) 2% Ultratex TC840 | 15 | 7 | 15 | 6 |
| 5. Example 4e) 1.5% Edonine S.E. conc. | 22 | 4 | 24 | 3 |
| 6. Example 4f) 1.5% VP1487E | 34 | =1 | 19 | 5 |
| 7. Example 4g) 0.3% Polymer of Example 1c coapplied with 1.2% Polymer of Example 1g | 27 | 3 | 36 | 1 |
| 8. Example 4h) 0.5% Sandofix TPS | 17 | =5 | 31 | 2 |

-continued

| Application | HANDLE ASSESSMENT RESULTS BEFORE WASH *Points | Ranking | AFTER 10 HLCC7 WASHES *Points | Ranking |
|---|---|---|---|---|
| followed by 1.2% Polymer of Example 1g | | | | |
| 9. Untreated | 4 | 9 | 8 | 9 |

*Maximm (best) possible = 36
Minimum (worst) possible = 4

EXAMPLE 5a 186 kg of cotton/nylon terry loop socks in 2,500 litres of water (liquor volume to sock weight ratio=13.8:1) were dyed to a light grey in a Dytex (rotary) machine. After dyeing the goods were thoroughly rinsed three times to remove residual processing auxiliaries (e.g. anionic chemicals) which could interfere with the exhaustion of the cationic durable softener system.

A fresh bath was set up at pH 7.5 and 20° C. 0.3% Polymer of Example 1c o.w.g. (558 grams, prediluted in 100 litres of water) was added over 10 minutes. Temperature raised to 30° C. and run for a further 5 minutes. 1.2% Polymer of Example 1 g o.w.g. (2,232 g prediluted in 100 litres of water) was added over 10 minutes. Machine ran until polymer bath completely exhausted (took approximately 10 minutes after drip feeding). The bath was dropped and the socks hydroextracted in the Dytex, tumble dried in a Passat dryer and postboarded (as in Example 2a).

EXAMPLE 5b 124 kg of cotton/nylon terry loop socks in 3,600 litres of water (liquor to sock ratio =29:1) were dyed to a light grey in a paddle machine. After dyeing the goods were rinsed three times then 0.3% Polymer of Example 1c o.w.g. (372 grams) and 1.2% Polymer of Example 1 g (1,488 grams) applied as in Example 4. After exhausting the polymer the bath was dropped, socks removed from the paddle machine, hydroextracted then tumble dried in a Passat dryer and postboarded as in Example 2a).

EXAMPLE 5c 181 kg of cotton/nylon terry loop socks in 2,500 litres of water (liquor to sock ratio =13.8:1) were dyed to a light grey in a Dytex machine. After dyeing the socks were rinsed three times.

A fresh bath was set up at pH 7.0 and 20° C. A combination of 0.3% Polymer of Example 1c o.w.g. (543 grams) and 1.2 % Polymer of Example 1 g o.w.g. (2,172 grams) prediluted in 100 litres of water was added over 10 minutes. The temperature was increased to 30° C. and the machine ran until the polymer system had completely exhausted (took approximately 8 minutes at 30° C.). The bath was dropped and the socks hydroextracted in the Dytex, tumble dried in a Passat dryer and postboarded as in Example 2a).

EXAMPLE 5d

Effectiveness of treatments applied in Example 5a, 5b and 5c was evaluated by subjecting to 5 HLCC4 washes and carrying out handle assessments. Commercially softened socks (2% Ceranine PNP/1% Lubricant SPC) dyed to the same shade and untreated (not softened) socks from the same bath were included for comparative purposes. Results are shown overleaf:

| Application | HANDLE ASSESSMENT RESULTS BEFORE WASH Points | Ranking | AFTER 10 HLCC4 WASHES Points | Ranking |
|---|---|---|---|---|
| 1. Example 5a 0.3% Polymer of Example 1c followed by 1.2% Polymer of Example 1g in Dytex | 14 | =2 | 15 | 3 |
| 2. Example 5b 0.3% Polymer of Example 1c followed by 1.2% Polymer of Example 1g in paddle machine | 14 | =2 | 16 | 2 |
| 3. Example 5c 0.3% Polymer of Example 1c coapplied with 1.2% Polymer of Example 1g in Dytex rotary machine | 16 | 1 | 17 | 1 |
| 4. 2% Ceranine PNP/1% Lubricant SPC in Dytex machine | 12 | 4 | 7 | 4 |
| 5. Untreated (not softened) socks | 4 | 5 | 5 | 5 |

EXAMPLE 6—Application to 9 Gauge Knitted Cotton Garments

Dyed 9 gauge knitted piece dyed cotton garments were wet out by stirring in a sample paddle machine at pH 6.5 for 5 minutes at 40° C. 0.3% Polymer of Example 1c o.w.g. and 1.2% Polymer of Example 1 g o.w.g. prediluted with water was added to the bath and stirred until the polymer system had exhausted onto the garments. The garments were hydroextracted, dried and trimmed.

Effectiveness of treatments applied in Example 6 was evaluated by subjecting to 5 HLCC4 washes and carrying out handle assessments. Commercially softened garments (1% Ceranine PNP) dyed to the same shade and untreated (not softened) garments from the same bath were included for comparative purposes.

The handle assessments after washing showed that the new polymer finish was durable—the garment was still soft, flexible and displayed good elastic recovery on stretching. However both the garment softened with Ceranine PNP and the untreated (unsoftened) garment were harsh, clothy and displayed poor elastic recovery on stretching.

EXAMPLE 7a—Application to Cotton/Shetland Garments

Knitted garments containing 50% cotton and 50% Shetland wool were milled/scoured (at a 20:1 liquor volume to garment weight ratio) in a sample rotary machine using 6% Millscour XBN (non ionic scouring agent, Precision Processes (Textiles) Limited) o.w.g. at 45° C. for approximately 5 minutes. A second scour was carried out in a sample paddle machine (at a 30:1 liquor volume to garment weight ratio) containing 3% Millscour XBN o.w.g. at 40° C. for 10 minutes. The garments were thoroughly rinsed.

The garments were stirred in a sample paddle machine at pH 6.5 for 5 minutes at 30° C. A combination of 0.3% Polymer of Example 1c o.w.g. and 1.2% Polymer of Example 1 g o.w.g. prediluted with water was added over 5 minutes, After the polymer system had exhausted onto the garments, they were hydroextracted, tumble dried and trimmed.

EXAMPLE 7b—Application to Cotton/Lambswool Garments

Knitted garments containing 50% cotton and 50% lambswool were scoured and milled then treated with a combination of 0.3% Polymer of Example 1c o.w.g. and 1.2% Polymer of Example 1 g o.w.g. as in Example 7a.

EXAMPLE 7c—Application to Cotton/Silk Garments

Knitted garments containing 65% cotton and 35% silk were scoured then treated with a combination of 0.3% Polymer of Example 1c o.w.g. and 1.2% Polymer of Example 1 g o.w.g. at pH 6.5 as in Example 7a but at 25° C.

EXAMPLE 7d

Effectiveness of treatments applied in Examples 7a–c was measured by subjecting to 10 HLCC7 washes. Garments which were softened with standard softener (i.e. 3% Ceranine PNP in all cases) from each of the same batches were included for comparative purposes.

The handle assessments after washing showed that the new polymer finish is durable on all these cotton blends while the standard softener used, Ceranine PNP, is completely removed by washing. Some felting occurred of the wool components of garments from Examples 7a and 7b during washing.

We claim:

1. A method for imparting a durable soft handle to cellulosic fibres which comprises treating the fibres with (1) an amino functional polymer containing reactive groupings, and (2) a silicone polymer bearing amino, thiol or epoxy functional groups capable of reacting with the reactive groupings of the amino functional polymer, said polymers (1) and (2) being applied as aqueous solutions or dispersions and either in the same step or in successive steps, wherein said amino functional polymer has been produced in a prior step by reacting (a) a precursor amine-containing polymer selected from the group consisting of (i) amino amides produced by reacting a di- or polyfunctional acid with a polyamine containing three or more amino groups, (ii) condensation polymers produced by reacting dicyandiamide and a polyamine containing three or more amino groups, (iii) polyethylene imine, and (iv) addition polymers, prepared from ethylene oxide, acrylic acid, and acrylonitrile, into which amino functional groups have been introduced by subsequent reaction or by copolymerisation of a suitable comonomer already bearing an amino functional group; with (b) a di or polyfunctional reactive species selected from the group consisting of epichlorohydrin, di- or polyepoxy compounds, polyhalogenated hydrocarbons, and short chain amine/epichlorohydrin prepolymers, such that the cellulosic fibres have a softer handle than untreated fibres.

2. A method as claimed in claim 1, wherein the cellulosic fibres are cotton.

3. A method as claimed in claim 1, wherein the silicone polymer is used in a major proportion and the amino functional polymer is used in a minor proportion.

4. A method as claimed in claim 1, wherein the amino functional polymer and the silicone polymer are applied to the fibres together.

5. A method as claimed in claim 1, wherein the amino functional polymer is applied to the fibres before the silicone polymer.

6. A method as claimed in claim 1, wherein the amino functional polymer is applied to the fibres in an amount of from 0.01 to 0.5% on the weight of fibre.

7. A method as claimed in claim 1, wherein the silicone polymer is applied to the fibres in an amount of from 0.1 to 3.0% on the weight of fibre.

8. A method as claimed in claim 1, which is in the form of a continuous process.

9. A method as claimed in claim 1, which is in the form of a batch process.

10. A method as claimed in claim 1, wherein the amino functional polymer and the silicone polymer are applied to the fibres together in a co-application technique, or successively in a post-application technique, or in a combination of said techniques.

* * * * *